US009254426B2

(12) United States Patent
Sandoval et al.

(10) Patent No.: US 9,254,426 B2
(45) Date of Patent: Feb. 9, 2016

(54) ANTI-THEFT DEVICE FOR A GOLF CLUB

(71) Applicants: David Michael Sandoval, Huntington Beach, CA (US); XiaoZhong Ling, Hangzhou (CN)

(72) Inventors: David Michael Sandoval, Huntington Beach, CA (US); XiaoZhong Ling, Hangzhou (CN)

(73) Assignee: David Michael Sandoval, Huntington Beach, CA (US)

( * ) Notice: Subject to any disclaimer, the term of this patent is extended or adjusted under 35 U.S.C. 154(b) by 0 days.

(21) Appl. No.: 14/296,292

(22) Filed: Jun. 4, 2014

(65) Prior Publication Data

US 2015/0009033 A1 Jan. 8, 2015

(30) Foreign Application Priority Data

Jun. 5, 2013 (CN) ..... 2013 2 0326376

(51) Int. Cl.

| | |
|---|---|
| ***G08B 13/14*** | (2006.01) |
| ***A63B 55/00*** | (2015.01) |
| *A63B 53/02* | (2015.01) |
| *A63B 57/00* | (2015.01) |

(52) U.S. Cl.

CPC ..... *A63B 55/00* (2013.01); *G08B 13/1436* (2013.01); *A63B 53/02* (2013.01); *A63B 57/00* (2013.01); *A63B 2055/002* (2013.01); *A63B 2055/403* (2015.10)

(58) Field of Classification Search

CPC . G08B 13/149; A63B 55/00; A63B 2055/001

USPC ..... 340/568.6, 568.1, 571, 572.9; 70/57.1, 70/14, 19

See application file for complete search history.

(56) References Cited

U.S. PATENT DOCUMENTS

| | | | | |
|---|---|---|---|---|
| 7,134,302 | B2 * | 11/2006 | Gorst | 70/57.1 |
| 7,266,979 | B2 | 9/2007 | Belden, Jr. | |
| 7,394,376 | B1 | 7/2008 | Sayegh et al. | |
| 7,458,241 | B2 | 12/2008 | Belden, Jr. | |
| 8,201,506 | B1 | 6/2012 | Parlapiano | |
| 8,264,350 | B2 | 9/2012 | Perez et al. | |
| 8,269,631 | B2 * | 9/2012 | Yang | 340/572.1 |
| 8,421,633 | B2 | 4/2013 | Yang | |
| 8,482,414 | B2 | 7/2013 | Leyden et al. | |
| 2006/0021394 | A1 * | 2/2006 | Belden | 70/57.1 |
| 2006/0070410 | A1 | 4/2006 | Fuss et al. | |
| 2012/0050042 | A1 * | 3/2012 | Shute et al. | 340/572.1 |

* cited by examiner

*Primary Examiner* — Toan N Pham

(74) *Attorney, Agent, or Firm* — Sheppard, Mullin, Richter & Hampton LLP

(57) ABSTRACT

An anti-theft device for a golf club having a cover comprising an internal surface adapted to conform to a golf club hosel and a portion of a golf club shaft. One or more sensors are disposed within the internal surface of the cover and adapted to actuate between a passive state and an alarm alert state. An alarm is coupled to the one or more sensors, the alarm emitting a signal when the one or more sensors are actuated from the passive state to the alarm alert state. The one or more sensors are retracted in the passive state when the golf club hosel is housed within the cover. The one or more sensors are advanced in the alarm alert state when the golf club hosel is removed from the cover.

20 Claims, 2 Drawing Sheets

ANTI-THEFT DEVICE FOR A GOLF CLUB

CROSS-REFERENCE TO RELATED APPLICATIONS

This application claims the benefit of priority under 35 U.S.C. §119 to Chinese Patent Application No. 2013 2 0326376, filed Jun. 5, 2013, the entire contents of which are incorporated herein by reference in its entirety.

FIELD OF THE INVENTION

The present invention is directed to an anti-theft device for a golf club and, more particularly, an anti-theft device for preventing the removal of a golf club head from its shaft.

BACKGROUND

Theft of golf clubs has become commonplace, owing primarily to the expensive nature of golf clubs. As a result, golf clubs have either been secured to a display or have had various security devices attached to them. One significant limitation of prior art security devices that attach to the shaft of the golf clubs is that they do not prevent the theft of golf club heads themselves, which represent the more expensive component of a golf club.

What is therefore needed are security devices that prevent the theft of golf club heads separately from their associated shafts.

BRIEF SUMMARY

In a first embodiment, an anti-theft device for a golf club is provided. The anti-theft device comprises a cover, one or more sensors, and an alarm coupled to the one or more sensors. The cover comprises an internal surface adapted to conform to and house a golf club hosel and a portion of a golf club shaft. The one or more sensors are disposed within the internal surface of the cover and are adapted to actuate between a passive state and an alarm alert state. An alarm is coupled to the one or more sensors, the alarm emitting a signal when the one or more sensors are actuated from the passive state to the alarm alert state.

In accordance with a first aspect, the cover is a clam shell comprising an upper half and a lower half joined by a hinge and coupled together in a closed position by a lock.

In accordance with a second aspect, the internal surface defines a first cylindrical cavity having a first diameter to conform to the hosel and a second cylindrical cavity having a second diameter to conform to the shaft. The first diameter is preferably greater than the second diameter.

In accordance with a third aspect, the one or more sensors are disposed within the first cylindrical cavity.

In accordance with a fourth aspect, the one or more sensors are retracted in the passive state and advanced in the alarm alert state.

In accordance with a fifth aspect, the one or more sensors are retracted in the passive state when the hosel is housed within the internal surface.

In accordance with a sixth aspect, the one or more sensors are advanced in the alarm alert state when the hosel is removed from the internal surface.

In a second embodiment, an anti-theft device for a golf club is provided. The anti-theft device comprises a housing and one or more sensors. The housing is configured to couple to at least a portion of a golf club head and a shaft. The one or more sensors are adapted to be in a passive state when in contacting engagement with the golf club head and in an alarm state when the one or more sensors are not in contacting engagement with the golf club head.

In accordance with a first aspect, an internal surface of the housing defines a first cylindrical cavity having a first diameter to conform to a hosel of the golf club head and a second cylindrical cavity having a second diameter to conform to the shaft.

In accordance with a second aspect, the first diameter is greater than the second diameter.

In accordance with a third aspect, the one or more sensors are disposed within the first cylindrical cavity.

In accordance with a fourth aspect, the one or more sensors are projections that protrude from a surface of the housing in the alarm state and are retracted into the housing in the passive state.

In accordance with a fifth aspect, the one or more sensors emit a signal when in the alarm state. In a preferred embodiment, the signal is an audible sound.

In a further embodiment, an anti-theft device for a golf club is provided. The anti-theft device comprises a housing, one or more sensors and an alarm coupled to the one or more sensors. The housing comprises a first internal cavity shaped to conform at least a portion of a golf club head and a second internal cavity shaped to conform to at least a portion of a golf club shaft. The one or more sensors are disposed within the first internal cavity and are adapted to actuate between a passive state and an alarm alert state. An alarm is coupled to the one or more sensors, the alarm emitting a signal when the one or more sensors are actuated from the passive state to the alarm alert state.

In accordance with a first aspect, the one or more sensors are disposed within the first internal cavity.

In accordance with a second aspect, the one or more sensors are protrusions which are retracted in the passive state and advanced in the alarm alert state.

In accordance with a third aspect, the first internal cavity is shaped to conform to a hosel.

In accordance with a fourth aspect, the one or more sensors are in the retracted state when the hosel is housed within the first internal cavity and the one or more sensors are in the alarm alert state when the hosel is removed from the first internal cavity.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Preferred and non-limiting embodiments of the inventions may be more readily understood by referring to the accompanying drawings in which.

Like numerals refer to like parts throughout the several views of the drawings.

DETAILED DESCRIPTION OF THE PREFERRED EMBODIMENT

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

Figure 1:
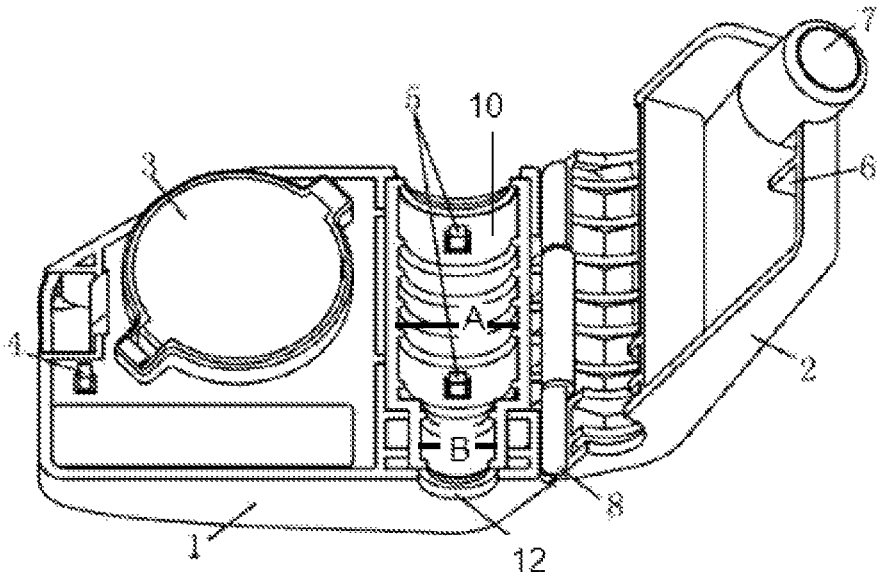
FIG. 1 is a perspective view of an embodiment of an anti-theft device for a golf club head in an open position.
Figure 2:
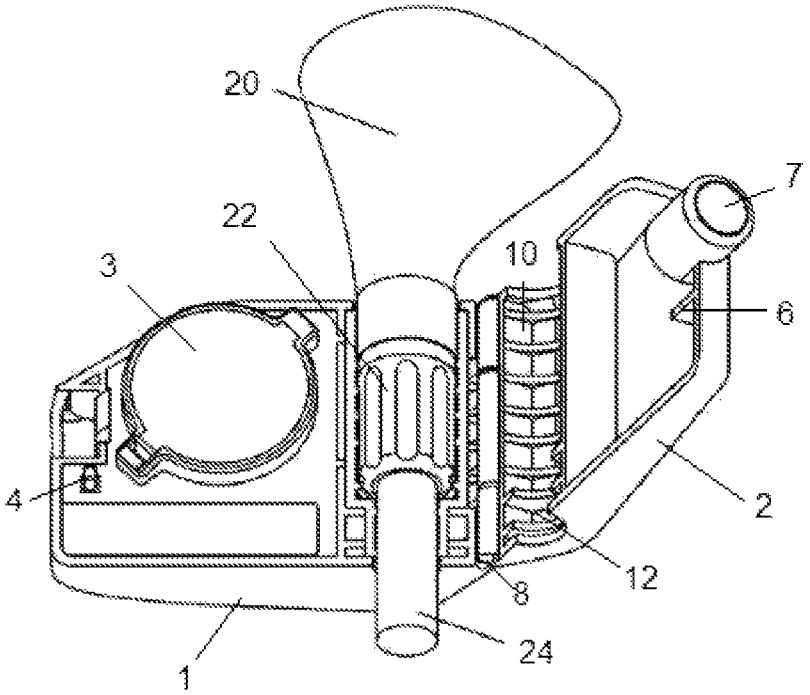
FIG. 2 is a perspective view of the anti-theft device with a golf club properly positioned therein for locking.
Figure 3:
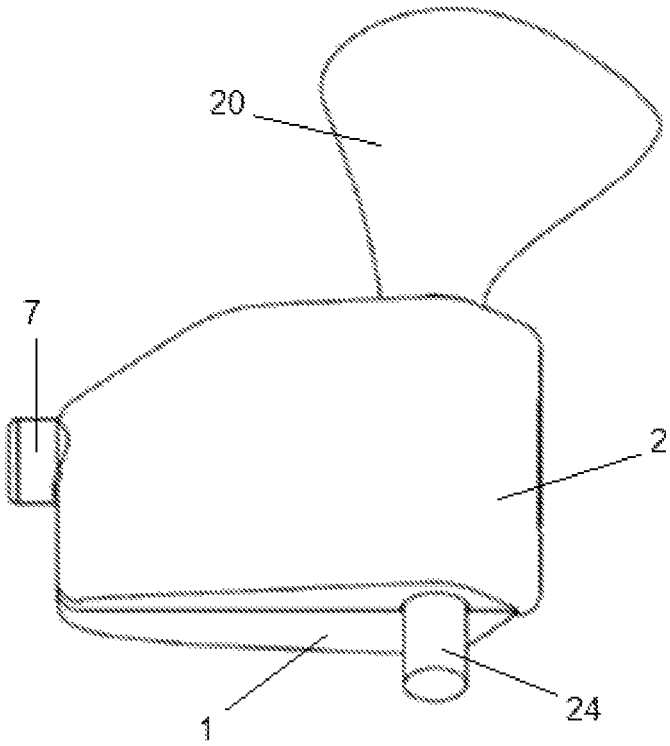
FIG. 3 is a perspective view of the anti-theft device locked around the properly positioned golf club.

FIGS. 1-3 depict one embodiment of the anti-theft device configured to couple to a golf club to prevent theft of the gold club head from the shaft. Generally, the anti-theft device housing comprises a lower cover 1 and an upper cover 2 rotatably coupled together by a hinge 8. When the lower and upper covers 1, 2 are joined together, as depicted in FIG. 3, the housing defines an internal cylindrical cavity to accommodate at least a portion of a golf club head and a shaft. In a preferred embodiment, the cylindrical cavity provides a close or snug fit with the golf club hosel 22 and a portion of the shaft 24.

The golf club head is understood to comprise the head portion 20 and the hosel 22, which is the socket or neck in the head portion 20 into which the shaft 24 is inserted. As can be observed in FIG. 2, the diameter of the hosel 22 is larger than the diameter of the shaft 24. Thus, the diameter A of a first cavity 10 configured to house the hosel 22 is larger than the diameter B of a second cavity 12 configured to house the shaft 24. The internal cavity generally forms a cylindrical sleeve having different diameters A, B by corresponding cavities 10, 12 when the lower and upper covers 1, 2 are joined together.

Sensors 5 are disposed on the internal surface of the first cavity 10 and are configured to be in contacting engagement with the hosel 22. In a preferred embodiment and as depicted in FIG. 1, the sensors 5 are spring-actuated protrusions which are biased to project outwardly of the internal surface of the first cavity 10. The sensors 5 may be actuated between a passive state and an alarm alert state. In a preferred embodiment, the sensors 5 are in the passive state when they are depressed by contact with the hosel 22 and are spring-biased to project outwardly in the alarm alert state when the hosel 22 is removed from the housing and thus contact between the hosel 22 and sensors 5 is lost. While the sensors 5 are depicted herein as being a mechanical sensor, it is understood that any number of other sensor types may be implemented, such as optical or electrical sensors. The function of the sensor 5 is to detect when the head portion 20 or the hosel 22 is removed from the housing. As such, the sensors 5 are located within the first cavity 10 which houses the hosel 22.

An alarm device (not shown) is disposed within the housing of the lower cover 1 and is coupled to a power source 3, e.g., a button battery. The alarm device is also coupled to the sensors 5 and monitors the state of the sensors 5, whether they are in a passive state or an alarm alert state. In one preferred embodiment, the alarm device emits an alarm signal when the sensors 5 are actuated from a passive state to an alarm alert state. In accordance with one embodiment, the alarm signal may be an audible siren that is emitted from the anti-theft device. In accordance with another embodiment, the alarm signal may be transmitted to a receiving unit that is disposed separately from the anti-theft device and the receiving unit may emit an audible siren or other notification.

The alarm device may also be coupled to a switch 4 to detect when the lower and upper covers 1, 2 have become separated. FIG. 2 depicts the switch 4 as being disposed on the lower cover 1. In one preferred embodiment, the switch 4 may be in passive state when the lower and upper covers 1, 2 are closed together (FIG. 3), such that the projection depresses the switch 4. The switch 4 may be actuated to an alarm alert state when the lower and upper covers 1, 2 are open (FIGS. 1 and 2) and the switch 4 is spring-biased to project outwardly. As with the sensors 5, actuation of the switch 4 from the passive state to the alarm alert state causes the alarm device to emit an alarm signal which may be an audible siren from within the device or from an external device.

The operation of the anti-theft device is provided as follows. First, the lower and upper covers 1, 2 are separated from one another, as shown in FIG. 1, to expose the cylindrical cavities 10, 12. A golf club is positioned within the anti-theft device by placing the hosel 22 within the cylindrical cavity 10 having the larger diameter A and the shaft 24 within the cylindrical cavity 12 having the smaller diameter B, as shown in FIG. 2. The lower and upper covers 1, 2 are closed and locked together by way of a lock 7, thereby securing within the device both at least portions of the hosel 22 and the shaft 24. The switch 4 and the sensors 5 and engaged in the retracted passive state. In the event that the lower and upper covers 1, 2 are separated or the hosel 22 is removed from the cylindrical cavity 10, the switch 4 or sensors 5 will, under the influence of a spring bias, actuate to an alarm alert state and cause the alarm device to emit an alarm signal. The alarm signal may cause an audible alarm to be emitted either from the anti-theft device itself or from a remotely located unit that receives the alarm signal from the device.

The invention described and claimed herein is not to be limited in scope by the specific preferred embodiments disclosed herein, as these embodiments are intended as illustrations of several aspects of the invention. Indeed, various modifications of the invention in addition to those shown and described herein will become apparent to those skilled in the art from the foregoing description. Such modifications are also intended to fall within the scope of the appended claims.

What is claimed is:

1. An anti-theft device for a golf club comprising:

a cover comprising an internal surface adapted to conform to and house a golf club hosel and a portion of a golf club shaft;

one or more sensors disposed within the internal surface of the cover, the one or more sensors being located along the internal surface that is adapted to conform to and house a golf club hosel, the one or more sensors adapted to actuate between a passive state and an alarm alert state; and an alarm coupled to the one or more sensors, the alarm emitting a signal when the one or more sensors are actuated from the passive state to the alarm alert state.

2. The anti-theft device of claim 1, wherein the cover is a clam shell comprising an upper half and a lower half joined by a hinge and coupled together in a closed position by a lock.

3. The anti-theft device of claim 2, wherein the internal surface defines a first cylindrical cavity having a first diameter to conform to the hosel and a second cylindrical cavity having a second diameter to conform to the shaft.

4. The anti-theft device of claim 3, wherein the first diameter is greater than the second diameter.

5. The anti-theft device of claim 3, wherein the one or more sensors are disposed within the first cylindrical cavity.

6. The anti-theft device of claim 1, wherein the one or more sensors are retracted in the passive state and advanced in the alarm alert state.

7. The anti-theft device of claim 6, wherein the one or more sensors are retracted in the passive state when the hosel is housed within the internal surface.

8. The anti-theft device of claim 6, wherein the one or more sensors are advanced in the alarm alert state when the hosel is removed from the internal surface.

9. An anti-theft device for a golf club comprising:

a housing configured to couple to at least a portion of a golf club head and a shaft; and one or more sensors adapted to be in a passive state when the one or more sensors are in contacting engagement with the golf club head and in an alarm state when the one or more sensors are not in contacting engagement with the golf club head.

10. The anti-theft device of claim 9, wherein an internal surface of the housing defines a first cylindrical cavity having a first diameter to conform to a hosel of the golf club head and a second cylindrical cavity having a second diameter to conform to the shaft.

11. The anti-theft device of claim 10, wherein the first diameter is greater than the second diameter.

12. The anti-theft device of claim 10, wherein the one or more sensors are disposed within the first cylindrical cavity.

13. The anti-theft device of claim 9, wherein the one or more sensors are projections that protrude from a surface of the housing in the alarm state and are retracted into the housing in the passive state.

14. The anti-theft device of claim 13, wherein the one or more sensors emit a signal when in the alarm state.

15. The anti-theft device of claim 14, wherein the signal is an audible sound.

16. An anti-theft device for a golf club comprising:

a housing comprising a first internal cavity shaped to conform at least a portion of a golf club head and a second internal cavity shaped to conform to at least a portion of a golf club shaft;

one or more sensors disposed within the first internal cavity, the one or more sensors adapted to actuate between a passive state and an alarm alert state; and an alarm coupled to the one or more sensors, the alarm emitting a signal when the one or more sensors are actuated from the passive state to the alarm alert state.

17. The anti-theft device of claim 16, wherein the one or more sensors are disposed within the first internal cavity.

18. The anti-theft device of claim 17, wherein the one or more sensors are in the retracted state when the hosel is housed within the first internal cavity and wherein the one or more sensors are in the alarm alert state when the hosel is removed from the first internal cavity.

19. The anti-theft device of claim 16, wherein the one or more sensors are protrusions which are retracted in the passive state and advanced in the alarm alert state.

20. The anti-theft device of claim 16, wherein the at least a portion of the golf club head is a hosel.

* * * * *